US005199333A

United States Patent [19]

Snyder, Jr.

[11] Patent Number: 5,199,333

[45] Date of Patent: Apr. 6, 1993

[54] WEDGE-GRIPPING TIE ROD END SOCKET WRENCH

[75] Inventor: Henry C. Snyder, Jr., Cleveland, Ohio

[73] Assignee: S.W.B.H. Efficient Systems, Inc., North Ridgeville, Ohio

[21] Appl. No.: 685,430

[22] Filed: Apr. 15, 1991

Related U.S. Application Data

[63] Continuation-in-part of Ser. No. 485,247, Feb. 26, 1990, abandoned.

[51] Int. Cl.[5] ..... B25B 13/00

[52] U.S. Cl. ..... 81/124.3; 81/176.15

[58] Field of Search ..... 81/124.2, 176.15, 176.2

[56] References Cited

U.S. PATENT DOCUMENTS 997,362 7/1911 Bamanshaw ..... 81/124.2

4,357,845 11/1982 Cornia ..... 81/124.2 X

*Primary Examiner*—James G. Smith

*Attorney, Agent, or Firm*—James H. Tilberry

[57] ABSTRACT

A socket wrench specially adapted to engage a tie rod end of an automobile steering system for rotating the tie rod end either for loosening or for tightening purposes. The socket is of a configuration wherein the tie rod end, comprising a ball joint and a pintle upstanding from the ball, can be securely wedge-gripped by the socket to apply a turning moment to the tie rod end even if the pintle has been broken off from the ball.

3 Claims, 3 Drawing Sheets

WEDGE-GRIPPING TIE ROD END SOCKET WRENCH

This application is a continuation-in-part of patent application Ser. No. 07/485,247, filed Feb. 26, 1990, now abandoned.

BACKGROUND OF THE INVENTION

1. Field of the Invention

The general field of invention is portable hand tools. In particular, the field of invention is wrenches, and, more particularly, socket wrenches. Specifically, the field of invention is high torque socket wrenches suitable for adjusting, removing, and replacing tie rod ends of vehicle steering linkage systems.

2. Description of Related Art

Various socket wrenches are known in the prior art to apply a turning moment by hand to irregular shaped objects which are not easily gripped by conventional tools. Thus, the patent to L. J. Stoll, U.S. Pat. No. 1,488,843, discloses a so-called cylinder tooth wrench specially adapted to engage nuts on a threshing machine which are otherwise difficult to reach with standard tools. The patent to McGuckin, U.S. Pat. No. 1,590,200, discloses a socket wrench in which the interior of the socket is serrated so as to engage and securely hold a round nut or a nut that is badly worn. The patent to K. Hoffman, U.S. Pat. No. 1,420,701, discloses a wrench specially adapted to engage and to turn shut-off valves. The patent to Meissner, Offenlegunschrift DE 3223109A1, issued by the Federal Republic of Germany, discloses a socket wrench having a slotted cylindrical sleeve to engage radiator valves located in inaccessible places, such as wall niches. These prior art wrenches are specialized tools, each of which is designed to perform a single function. None is designed or suitable for removing and installing tie rod ends. Since these prior art tools are hand manipulated, it is questionable how effective they would be if the object to be turned were frozen in place, thereby requiring a greater wrenching action than could be transmitted with the hand tools disclosed. None of these prior art patents teaches wedge-gripping or means to power these tools.

In the specific tie rod end art, the subject of this invention, the standard means for turning a tie rod end comprises a pair of pipe wrenches. One pipe wrench is applied to an intermediate tie rod link and positioned to prevent turning. The other pipe wrench is secured in a turning position on the tie rod end. Pipe wrenches are not amenable to power actuation. Thus, if the threaded joint connecting the tie rod end to an intermediate tie rod is frozen, great effort must be applied in equal and opposite directions to the pipe wrench handles. This effort oftentimes results in sudden slippage of the pipe wrench teeth, resulting in injury to the mechanic's hands and/or face.

SUMMARY OF THE INVENTION

The invention is a one-piece, portable, wedge-gripping, high torque socket wrench which needs no adjustment. It is specially adapted to wedge-grip the tie rod end of a vehicle steering linkage system and to apply a high torque turning moment thereto. Portable is defined to mean a hand tool of such limited dimensions and configuration as to be storable in a mechanic's tool box, and of such weight as to be manually liftable with one hand, positionable on a tie rod end ball joint and manually holdable in place on the workpiece by a horizontally extended arm during use. Specifically, the socket portion of the wrench is so configured that it can receive therein the irregular shape of a ball joint with or without an attached pintle used on tie rod ends with all models of automobiles. The socket is also provided with means to be engaged by a turning member, such as a pneumatic-powered speed wrench, whereby the tie rod end may be rotated to thread or to unthread the tie rod end from the remaining steering linkage. As used in this specification, passenger automobiles and trucks are included within the term vehicle, although embodiments of the invention for use on truck tie rod ends may have to be enlarged to accommodate larger truck ball joints.

The socket is hollow, multi-sided, and tapers from a wide open end toward a narrow closed end. The preferred embodiment is frusto-pyramidal in configuration, and is sized to receive within its enclosure a ball joint tie rod end. The taper of the sides is selected to cause the ball joint to be wedge-gripped between the interior surfaces of the sides when the ball joint is inserted in the socket. If undamaged, the ball of the ball joint has an upstanding pintle integrally secured thereto. Accordingly, a slot is provided in one of the sides of the socket to receive the pintle and to permit both the ball joint and pintle to be received within the socket. The slot is tapered so as to cause the pintle also to be wedge-gripped in the tapered slot after the ball joint has entered the socket a predetermined distance. When so positioned, a power tool can be applied to the socket to develop a turning torque far in excess of any torque possible by manual application. Thus, if the fittings are frozen together due to corrosion, rust, or the like, the socket and power tool combination will separate parts difficult or impossible to separate with manually applied hand tools.

OBJECTS OF THE INVENTION

It is, therefore, among the objects of this invention to provide a portable, one-piece, automobile tie rod end socket wrench which needs no adjustment and which provides novel wedge-gripping means to engage and to turn a tie rod end ball joint.

Another object of the invention is to provide a portable automobile socket wrench which will be effective to wedge-grip and to turn a tie rod end ball joint having an upstanding pintle.

It is another object of the invention to provide a tie rod end socket wrench which will be effective to wedge-grip and to turn a tie rod end ball joint even though it is damaged, the pintle has been broken off, and/or the ball joint has been severely corroded.

It is a further object of the invention to provide a tie rod end socket wrench wherein the socket is a one-piece, smooth, multi-sided, hollow, tapered, cowbell-shaped member sized to conveniently envelop and to wedge-grip a ball joint and its upstanding pintle by virtue of the taper of the sides and an elongated tapered slot in one of the sides sized to receive the upstanding pintle therethrough in wedge-gripping relationship.

Another object of the invention is to provide a tie rod end socket wrench wherein the socket is adapted to be actuated by a powered turning tool.

It is yet another object of the invention to provide an automobile socket wrench which will accommodate all tie rod end ball joints in present use.

A still further object of the invention is to provide a tie rod end socket wrench which is rugged, easy to maintain, and both easy and safe to use.

It is a still further object of the invention to provide a tie rod end socket wrench, the concept of which is equally applicable with respect to automobiles and to trucks, the only difference in reduction to practice being with respect to size.

Other objects and advantages of the invention will become apparent to those skilled in the art upon reading the following specification taken in conjunction with the accompanying drawings.

DESCRIPTION OF PREFERRED EMBODIMENTS OF THE INVENTION

Figure 1:
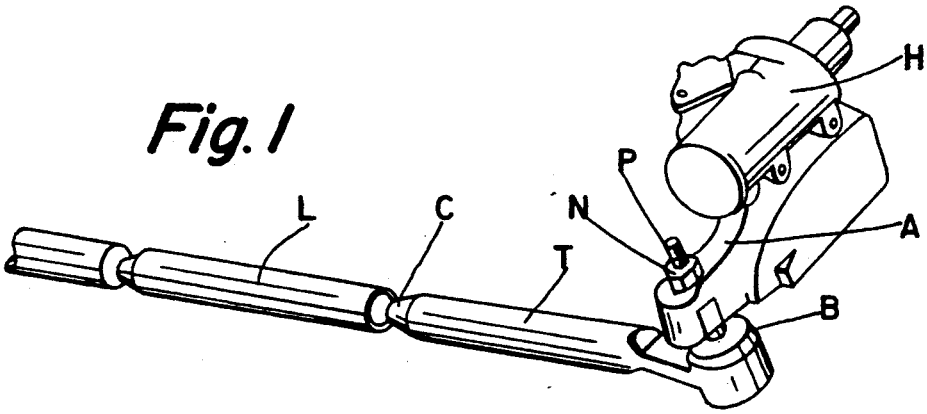
FIG. 1 is a perspective view of a tie rod end of an automobile steering system shown attached to an activating pitman arm and pitman arm hydraulic servo actuator.

Referring now to the drawings in greater detail, in FIG. 1 is shown a conventional automobile tie rod end T fitted with a ball joint B, having an upstanding threaded pintle P integrally secured thereto, and to which is connected a pitman arm A by a nut N. The pitman arm A is in turn drivingly connected to a hydraulic servo actuator H. There are many designs of steering systems and linkages, but generally it is commonplace for a hydraulic servo actuator H to turn a pitman arm A, which, as a result, shifts a tie rod end T. The tie rod end T is suitably connected to other linkages, such as link L, adapted to control the front wheels of a vehicle, all of which is well understood by those skilled in the art.

As shown, the tie rod end T is threadedly engaged on one end to a tie rod link L and is equipped with a ball joint B on the opposite end. In order to adjust the steering system, it is sometimes necessary to adjust the effective length of tie rod end T. Under other circumstances, it is necessary to remove and to replace the tie rod end T. This is done by threading tie rod end T into or out of engagement with link L.

Figure 2:
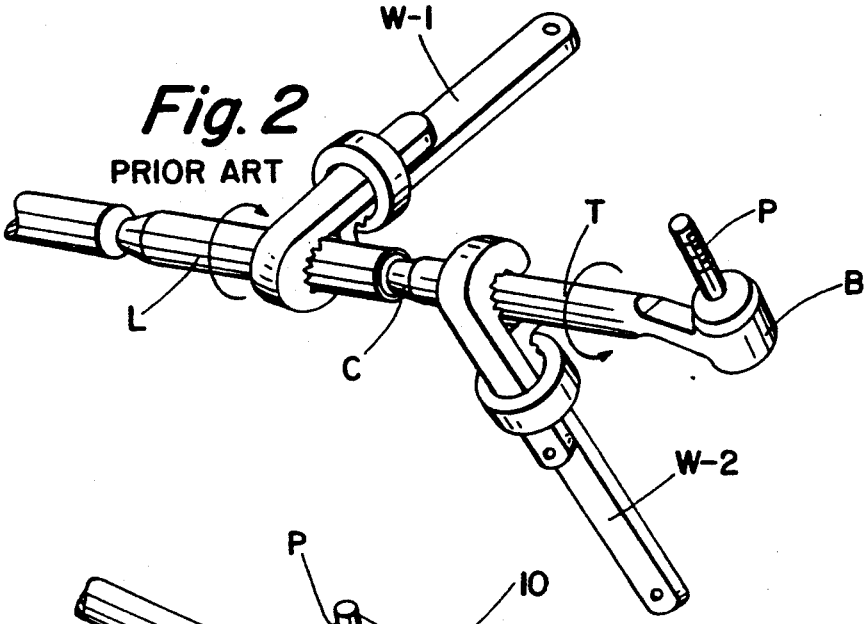
Fig. 2 PRIOR ART
FIG. 2 is a perspective view of the tie rod end of FIG. 1, disconnected from the pitman arm.

The accepted method of rotating tie rod end T is shown in FIG. 2. Nut N is first removed from pintle P to permit pitman arm A to be disengaged. Then, if the tie rod end is to be removed, a first pipe wrench W-1 is attached to link L to prevent it from rotating. A second pipe wrench W-2 is attached to tie rod end T to rotate the tie rod end counter-clockwise, as shown. However, if the threads at connection C are corroded or otherwise damaged, it is not always possible to break the connection C with only hand force applied to pipe wrench W-2. In such event, more time consuming and expensive methods must be resorted to, such as the use of an oxyacetylene torch to cut out the frozen part or parts. However, until it is determined that the tie rod end cannot be dislodged with the application of torque by pipe wrenches, there is always the danger that one or the other of the wrenches may slip, with possible resulting injury to the mechanic.

Figure 3:
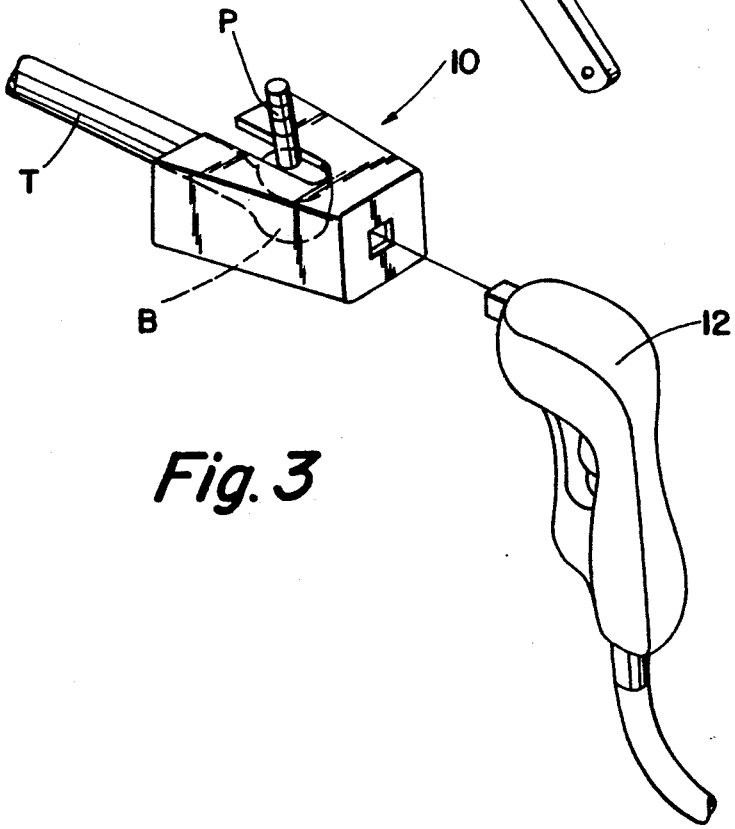
FIG. 3 is a perspective view of the tie rod end of FIG. 1 engaged by the inventive socket wrench and a power tool shown in partially exploded style.

Referring now to FIG. 3, therein is shown the inventive socket 10 in engagement with a tie rod end ball joint B and pintle P to be rotated by a powered torque device, such as a pneumatic speed wrench or electrically powered torque tool 12. The socket is shown in more explicit detail in FIGS. 4–8, and will now be described in conjunction with these figures.

In the first and preferred embodiment, the invention 10 is a hollow, four-sided, frusto-pyramidal one-piece socket which may be formed from non-magnetic welded steel plates, a steel forging, or a steel casting. Top side 14, FIG. 4, tapers from open end 16 converging toward closed end 18. It is provided with an elongated slot 20 also tapered from the open end 16 and converging toward the closed end 18. The cross section in phantom of a pintle P is shown wedge-gripped in the slot 20 mediate the open end 16 and the closed end 18. End 18 is closed by back member 22, and is provided with a rectangular opening 24 to receive a drive bit 26 of powered torque device 12.

Figure 4:
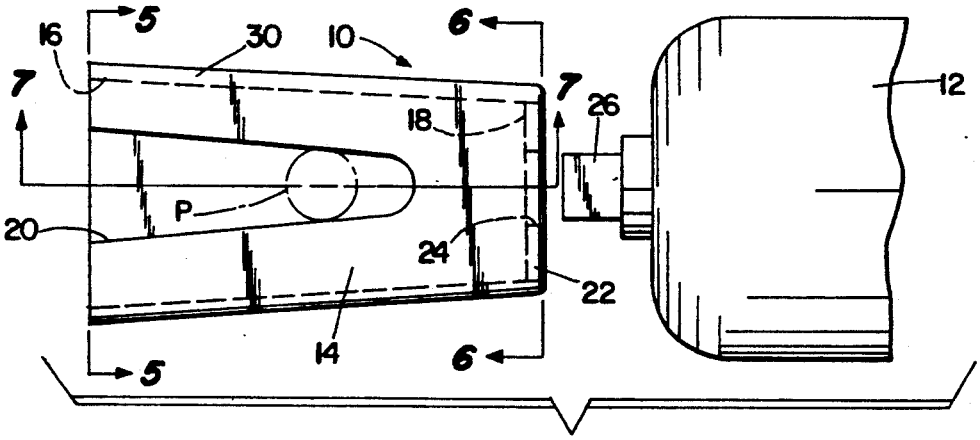
FIG. 4 is a top plan view of a first preferred embodiment of the invention.
Figure 5:
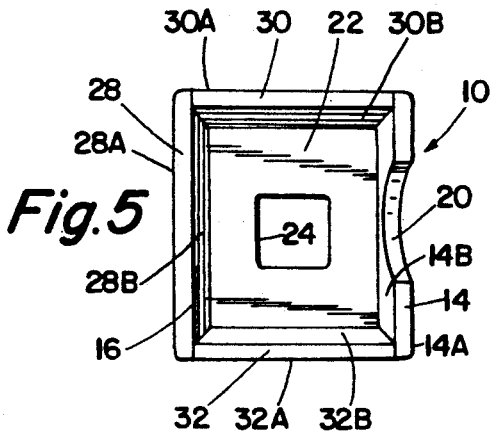
FIG. 5 is a front elevational view of the invention shown in FIG. 4, taken along the line 5—5 of FIG. 4.
Figure 6:
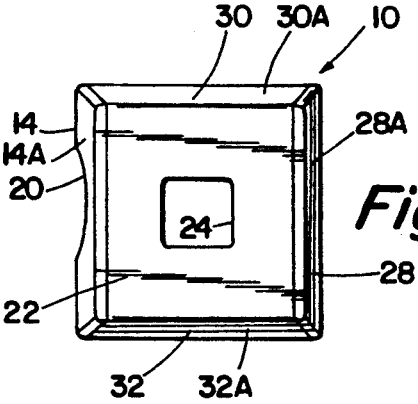
FIG. 6 is a rear elevational view of the invention shown in FIG. 4, taken along the line 6—6 of FIG. 4.
Figure 7:
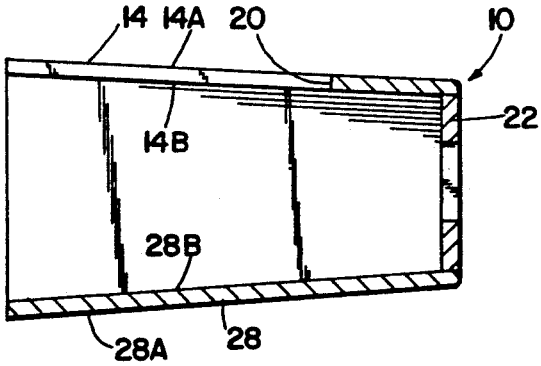
FIG. 7 is a sectional view of the invention taken along the line 7—7 of FIG. 4.

FIG. 5 is a front view of the socket 10 taken along the line 5—5 of FIG. 4. FIG. 6 is a rear view of the socket 10 taken along the line 6—6 of FIG. 4. FIG. 7 is a sectional view taken along the line 7—7 of FIG. 4. From an examination of these figures, it will be observed that, in the preferred embodiment of the invention, bottom plate 28 is the same size and tapered configuration as top plate 14, with the exception that bottom plate 28 has no slot. Side members 30 and 32 are also tapered, and serve to join top, bottom, and back plates 14, 28, and 22, respectively. As aforesaid, these plates may be welded together, or the socket 10 may be made from a monolithic forging or casting. If the inventive socket is to be fabricated by welding, it is preferably made from three pieces wherein a first piece comprises top member 14 and side member 30 formed by bending a piece of metal at the intersection of members 14 and 30. A second piece comprises bottom member 28 and side member 32, also formed by bending a piece of metal at the intersection of members 28 and 32. The first and second pieces are then welded at the intersection of members 14 and 32 and at the intersection of members 28 and 30. A third piece 22 is then welded to the rear edges of the first and second pieces.

As shown in FIGS. 5, 6, 7, and 8, it will be noted that top plate 14 has a smooth, planar exterior surface 14A, and a smooth planar interior surface 14B parallel to exterior surface 14A. Bottom plate 28 has a smooth planar exterior surface 28A and a smooth planar interior surface 28B parallel to exterior surface 28A. Side plate 30 has a smooth planar exterior surface 30A and a smooth planar interior surface 30B parallel to exterior surface 30A. Side plate 32 has a smooth planar exterior surface 32A and a smooth planar interior surface 32B parallel to exterior surface 32A. The smooth planar exterior surfaces 14A, 28A, 30A, and 32A function to facilitate the ease of entry and exit of the ball joint B, FIG. 3, into and out of socket 10 by eliminating all exterior surface redundancies which could cause a hang-up of the socket in the confined operating spaces in which the socket is intended to be used. The smooth planar interior surfaces 14B, 28B, 30B, and 32B also facilitate the ease of entry and exit of the ball joint B into and out of socket 10 by eliminating any protuberances, such as ribs or grooves, which could cause the ball joint to jam or hang-up in the socket.

In a first fabrication alternative, top member 14, back member 22, and bottom member 28 may be formed from a single U-shaped piece of metal, with sides 30 and 32 being welded thereto.

In a second fabrication alternative, the top, bottom, and two side members may be separately welded together with their back edges welded to the back member 22. In any case, the result is a hollow, four-sided, cowbell-shaped socket.

Figure 8:
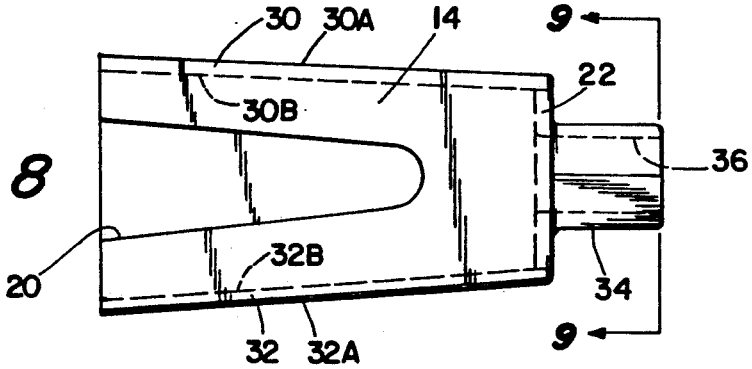
FIG. 8 is a top plan view of a second preferred embodiment of the invention showing an alternate means for attaching the socket turning member.
Figure 9:
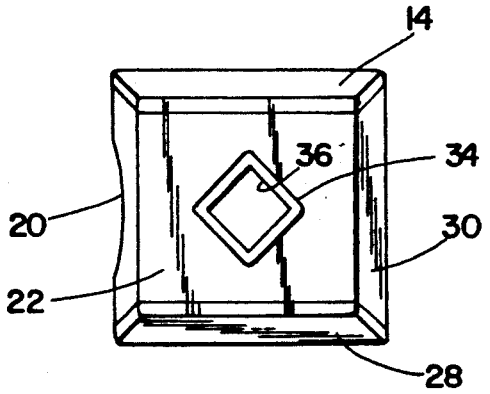
FIG. 9 is a rear elevational view of the invention shown in FIG. 8, taken along the line 9—9 of FIG. 8.

In a second embodiment of the invention, shown in FIGS. 8 and 9, instead of the rectangular hole 24 to receive the bit portion 26 of a driving tool, a multi-sided boss 34 is secured to back plate 22 to which a power torque tool may be attached externally. Boss 34 is also provided with a blind socket 36 for engagement by a bit type drive member, such as bit 26 of FIG. 4.

Figure 10:
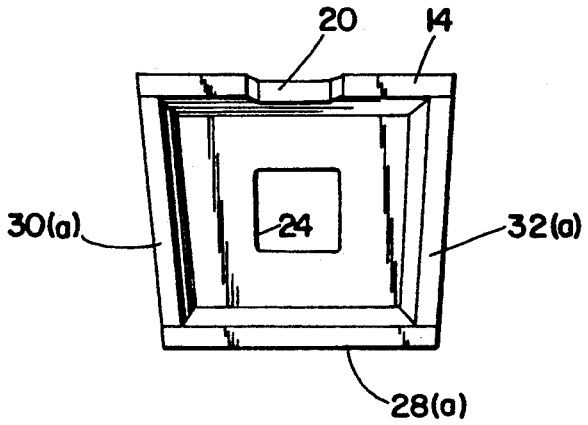
FIG. 10 is a front elevational view of a third embodiment of the invention.

In a third embodiment of the invention, shown in FIG. 10, wedge-gripping with closer approximation of the contour of ball joint B may be obtained by inclining side plates 30(*a*) and 32(*a*) inwardly between top plate 14 and bottom plate 28(*a*). Another form of this concept is shown in FIG. 11, wherein side plates 30(*b*) and 32(*b*) are bent along brake lines 38 and 40 to approximate the contour of ball joint B.

Figure 11:
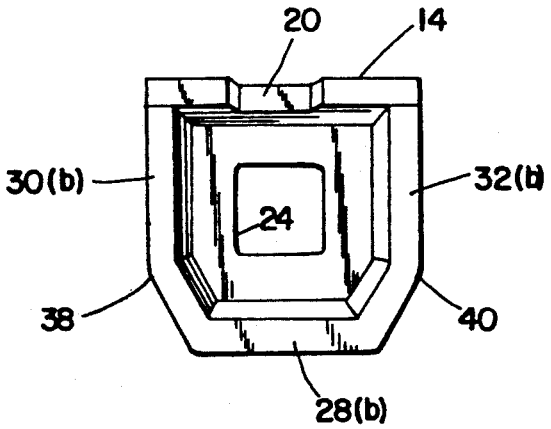
FIG. 11 is a front elevational view of a fourth embodiment of the invention.
Figure 12:
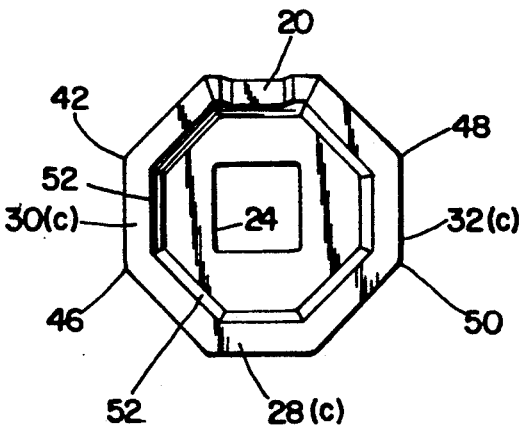
FIG. 12 is a front elevational view of a fifth embodiment of the invention.

The concept of FIG. 11 is further refined in FIG. 12, wherein side plate 30(*c*) is bent along brake lines 42 and 46 and side plate 32(*c*) is bent along brake lines 48 and 50 to more closely approximate the contour of ball joint B, but with interior surfaces 52 adapted to make frictional wedging contact with the ball joint to cause it to rotate with the socket.

The inventive socket 10 is the only specially adapted portable hand tool known to the inventor available to automobile mechanics for use in removing or installing tie rod ends which is power driven, safe and easy to use, requires no adjustment, is rugged but inexpensive, is easily cleaned, maintained, and repaired, and is not car model restricted.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

What is claimed:

1. A vehicle steering system tie rod end hand socket wrench for rotatably tightening or loosening a tie rod end having a ball joint with or without an upstanding pintle, comprising: a portable, non-magnetic, one-piece, wedge-gripping, hollow, smooth multi- sided frusto-pyramidal socket with an open base and a closed top; an open-ended slot in one of said sides extending from said open base longitudinally in one of said sides, and terminating in a blind end beneath said top, said slot being tapered from said base toward said blind end and sized to make wedge-gripping engagement with the pintle of a tie rod end ball joint mediate said base and said blind end; said sides being spaced apart and tapered from said base to said top to make wedge-gripping engagement with a tie rod end ball joint mediate said base and said top; said sides having interior and exterior smooth parallel surfaces adapted to provide quick engagement with and quick release from a tie rod end ball joint; and means to fasten a powered high torque tool to said top, whereby high torque may be applied to said wrench to turn said tie rod end ball joint, and whereby said tie rod end socket wrench is adapted to wedge-grip a plurality of sizes of tie rod end ball joints without need for adjustment.

2. The tie rod end socket wrench of claim 1, wherein said socket comprises four sides.

3. The tie rod end socket wrench of claim 2, wherein the opposite ends of said slotted side are wider than the correspondingly opposite ends respectively of the side opposite to said slotted side, whereby the sides mediate said slotted side and said opposite side are tapered inwardly from said slotted side toward said opposite side.

* * * * *